US007840172B2

(12) United States Patent
Yabuta

(10) Patent No.: US 7,840,172 B2
(45) Date of Patent: Nov. 23, 2010

(54) IMAGE FORMING APPARATUS

(75) Inventor: Junko Yabuta, Yamatokoriyama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 807 days.

(21) Appl. No.: 11/730,907

(22) Filed: Apr. 4, 2007

(65) Prior Publication Data

US 2007/0237557 A1 Oct. 11, 2007

(30) Foreign Application Priority Data

Apr. 5, 2006 (JP) ..... 2006-104157

(51) Int. Cl.
*G03G 15/00* (2006.01)

(52) U.S. Cl. ..... 399/405; 399/401

(58) Field of Classification Search ..... 399/401, 399/405

See application file for complete search history.

(56) References Cited

FOREIGN PATENT DOCUMENTS

JP 08-183174 A 7/1996
JP 10-020627 A 1/1998
JP 2002-192708 A 7/2002
JP 2005-215459 A 8/2005

*Primary Examiner*—Anthony H. Nguyen
(74) *Attorney, Agent, or Firm*—Birch, Stewart, Kolasch & Birch, LLP

(57) ABSTRACT

An image forming apparatus includes at least one paper feeding section, a plurality of image forming sections, a plurality of paper output sections, a main transport path, and a plurality of paper output paths. The paper feeding section stores a recording medium therein. Any one of the image forming sections selectively forms an image on a recording medium fed from the paper feeding section and being transported on the main transport path. Each of the paper output sections receives a recording medium bearing an image formed in any one of the image forming sections. The main transport path leads from the paper feeding section and runs through the image forming sections. The paper output paths branch from an end of the main transport path into the respective paper output sections.

4 Claims, 6 Drawing Sheets

FIG.6

| DESCRIPTIONS OF IMAGE FORMING CONDITIONS | | | | FIRST FLAPPER | SECOND FLAPPER | REMARKS |
|---|---|---|---|---|---|---|
| SIMPLEX OR DUPLEX | IMAGE TO BE FORMED | PAPER OUTPUT ORIENTATION | OUTPUT DESTINATION | | | |
| SIMPLEX IMAGE FORMING PROCESS | COLOR IMAGE | FACE-UP | SECOND SECTION | P1 | P5 | |
| | | FACE-DOWN | FIRST SECTION | P2 | – | |
| | BLACK-AND-WHITE IMAGE | FACE-UP | FIRST SECTION | P2 | – | |
| | | FACE-DOWN | SECOND SECTION | P1 | P5 | |
| DUPLEX IMAGE FORMING PROCESS | COLOR IMAGE | FACE-DOWN | FIRST SECTION | P2→P3→P2 | P4 | SWITCHBACKED START WITH SECOND SIDE |
| | | | SECOND SECTION | P2→P3→P1 | P4→P5 | SWITCHBACKED START WITH FIRST SIDE |
| | BLACK-AND-WHITE IMAGE | FACE-DOWN | FIRST SECTION | P2→P3→P2 | P4 | SWITCHBACKED START WITH FIRST SIDE |
| | | | SECOND SECTION | P2→P3→P1 | P4→P5 | SWITCHBACKED START WITH SECOND SIDE |
| | COLOR IMAGE ON FIRST SIDE AND BLACK-AND-WHITE IMAGE ON SECOND SIDE | FACE-DOWN | FIRST SECTION | P1→P2 | P4 | NOT SWITCHBACKED START WITH SECOND SIDE |
| | | | SECOND SECTION | P1→P2→P3 | P4→P5 | SWITCHBACKED START WITH FIRST SIDE |
| | BLACK-AND-WHITE IMAGE ON FIRST SIDE AND COLOR IMAGE ON SECOND SIDE | FACE-DOWN | FIRST SECTION | P1→P1→P3 | P4→P5 | SWITCHBACKED START WITH SECOND SIDE |
| | | | SECOND SECTION | P1→P1 | P4→P5 | NOT SWITCHBACKED START WITH FIRST SIDE |

IMAGE FORMING APPARATUS

CROSS REFERENCE

This Nonprovisional application claims priority under 35 U.S.C. §119 (a) on Patent Application No. 2006-104157 filed in Japan on Apr. 5, 2006, the entire contents of which are hereby incorporated by reference.

BACKGROUND OF THE INVENTION

The invention relates to an image forming apparatus that includes: a plurality of image forming sections each for forming an image on a recording medium fed from a paper feeding section; and a plurality of paper output sections to which a recording medium bearing an image is to be selectively output.

There are two known methods for color image formation: the electrophotographic method and the inkjet method.

The electrophotographic method has the advantage of fast image formation and low running costs. This is because developer agent is heated and pressurized to be fused and firmly fixed to a recording medium and because the developer agent is comparatively inexpensive. However, this method has the disadvantage of poor color reproducibility. This is because of the developer agent, which is the mixture of thermoplastic resin with pigments or dyes. Poor transparency of the thermoplastic resin has a negative effect. Also, heat applied in a fusing process causes a change in color of pigments or dyes.

On the other hand, the inkjet method has the advantage of good color reproducibility. This is because this method uses ink with high transparency to form an image without applying heat. However, this method has the disadvantage of slow image formation and high running costs. This is because it takes long to dry ink and because the ink is comparatively expensive.

In most cases, partially color images of a single color or multiple colors, such as seals, illustrations, or graphs, inserted in part of textual images are formed on a recording medium, rather than full-color images.

In view of the foregoing, a combined image forming apparatus has been proposed that is provided with two types of image forming sections: an electrophotographic black-and-white image forming section and an inkjet color image forming section (see JP H08-183174A and JP 2002-192708A).

When the combined image forming apparatus is used to form a black-and-white image and a color image on a recording medium, there is definitely a noticeable difference in image quality between the black-and-white and color images as formed.

As a solution to the problem, electrophotographic black-and-white and color image forming sections can be provided for the purpose of forming a mixed image of black-and-white and color images without a noticeable difference in quality therebetween as well as enabling fast black-and-white image formation.

However, mere provision of the two types of electrophotographic image forming sections results in a complex transport route for recording medium, which makes it harder to remove a possible jam.

A feature of the invention is to offer an image forming apparatus that is smaller in size and has a reduced number of component elements and an enhanced operability, by provision of a single transport route along which a recording medium is transported, regardless of which one of a plurality of image forming sections forms an image on the recording medium,

SUMMARY OF THE INVENTION

An image forming apparatus according to an aspect of the invention includes at least one paper feeding section, a plurality of image forming sections, a plurality of paper output sections, a main transport path, and a plurality of paper output paths. The main transport path and the paper output paths are formed so as to lead from the paper feeding section to the paper output sections through the image forming sections. The apparatus according to another aspect of the invention further includes a subsidiary transport path that branches from a midway branching point of any one of the paper output paths and joins a point of the main transport path upstream with respect to the image forming sections. In the apparatus, a recording medium is transported along a single transport route, regardless of which one of the image forming sections forms an image on the recording medium.

BRIEF DESCRIPTION OF THE DRAWINGS

FIG. 6 is a table illustrating a relationship between image forming conditions of the apparatus and positions of the first and second switching gates.

DETAILED DESCRIPTION OF THE INVENTION

With reference to the accompanying drawings, an image forming apparatus according to preferred embodiments of the invention will be described in detail below.

Figure 1:
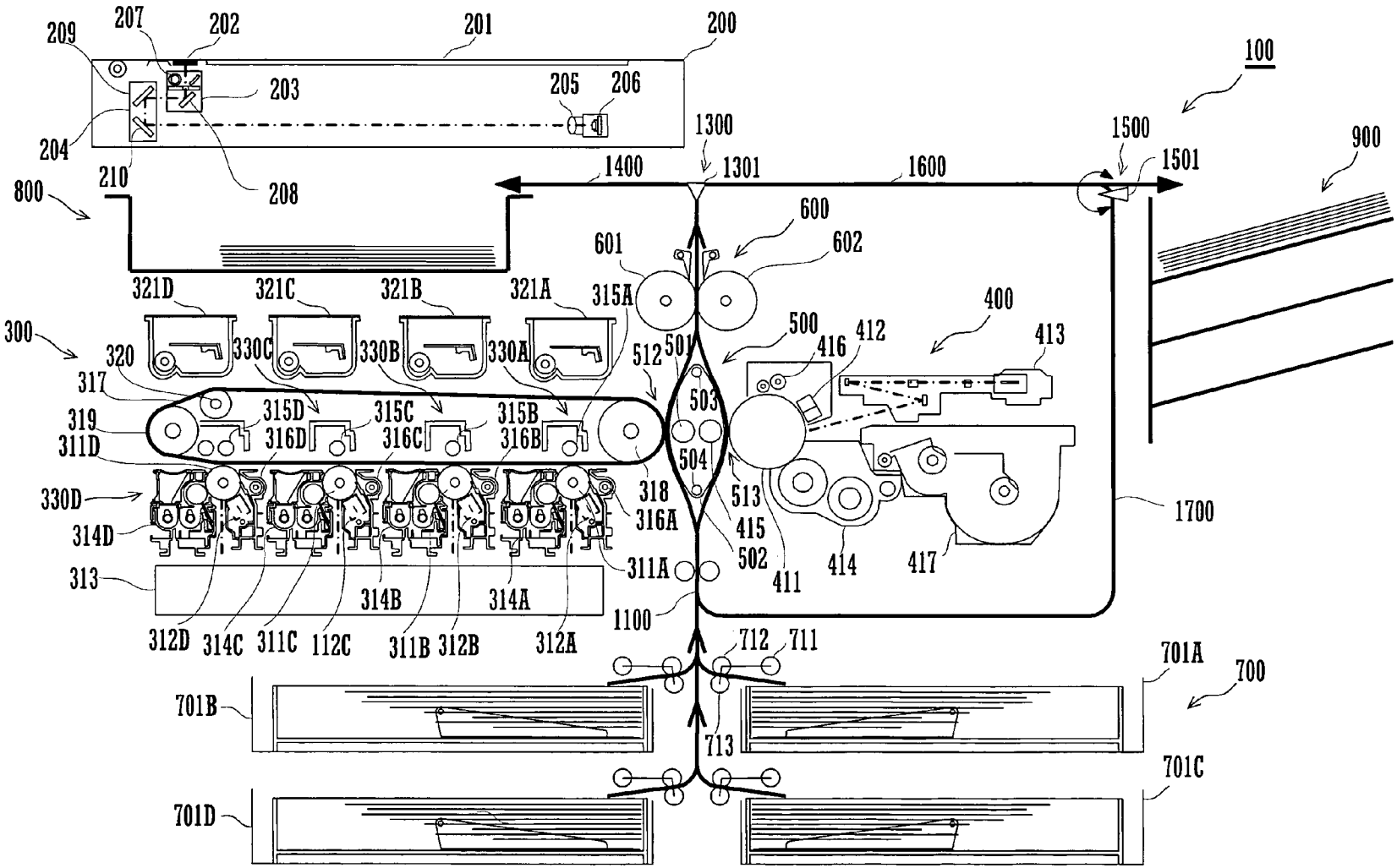
FIG. 1 is a schematic view of an image forming apparatus according to an embodiment of the invention.

FIG. 1 is a schematic view of an image forming apparatus 100 according to an embodiment of the invention. The apparatus 100 includes a scanner section 200, a color processing section (color image forming section) 300, a black-and-white processing section (black-and-white image forming section) 400, a transfer section 500, a fusing section 600, a paper feeding section 700, a first paper output section 800, and a second paper output section 900.

As an example, the section 200 is positioned at top of the apparatus 100. The sections 300 and 400 are positioned in lateral alignment in a middle portion of the apparatus 100, in such a manner as to face each other. The sections 500 and 600 are positioned between the sections 300 and 400, with the section 600 above the section 500. Positioned at the bottom of the apparatus, the section 700 stores therein various types of paper to be fed to the sections 300 and 400 as a recording medium when an image is to be formed.

A main transport path is formed so as to lead from the section 700 to a first bifurcation 1300 through the sections 500 and 600. In the path 1100, paper is transported only in a direction from the section 700 toward the bifurcation 1300. In the section 500, the path 1100 bifurcates into two tributary paths running through a first opposing portion 512 in the section 300 and a second opposing portion 513 in the section 400, respectively, and then unites at a downstream point.

A first paper output path 1400 is formed so as to lead from the bifurcation 1300 to the first paper output section 800. In the path 1400, paper is selectively transported in a direction from the bifurcation 1300 toward the section 800 and in a direction from the section 800 toward the bifurcation 1300. Transport members arranged in the path 1400 are selectively driven to transport paper in forward and reverse directions. Thus, the path 1400 is capable of transport paper in the forward and reverse directions, and thus is usable as a switch-back transport path for reversing paper in duplex image formation.

A second paper output path 1600 is formed so as to lead from the bifurcation 1300 to the second paper output section 900 through a second bifurcation 1500. In the path 1600, paper is transported only in a direction from the bifurcation 1300 toward the section 900.

A subsidiary transport path 1700 is formed so as to lead from the bifurcation 1500 to a midway point between the sections 700 and 500 in the path 1100. In the path 1700, paper is transported only in a direction from the bifurcation 1500 toward the midway point between the sections 700 and 500.

Paper as used herein as a recording medium includes plain paper, recycled paper, a sheet of OHP film, heavy paper (e.g., postcards), envelopes, etc. The section 800 is positioned between the sections 200 and 300. The section 900 is positioned on the right side of the section 400.

The section 200 has a first platen 201, a second platen 202, a first mirror base 203, a second mirror base 204, a lens 205, and a CCD sensor 206. The platens 201 and 202 each include hard glass. An original document is manually placed on the platen 201, or is fed thereto by an automatic document feeder (not shown in the figure). To the platen 202, an original document is fed by the automatic document feeder.

The base 203 has a lamp 207 and a first mirror 208 mounted thereon. The base 204 has a second mirror 209 and a third mirror 210 mounted thereon. In reading an image of original document placed on the platen 201, the bases 203 and 204 are moved horizontally below the platen 201, with the base 204 moving half as fast as the base 203. In reading an image of original document that is being passed on the platen 201 by the automatic document feeder, the base 203 is held still below the platen 202.

The lamp 207 irradiates an image-bearing side of original document. The mirrors 208 to 210 reflect the light reflected from the original document, toward the lens 205. The lens 205 focuses the reflected light on a light-receiving surface of the sensor 206. The sensor 206 outputs an electric signal according to the amount of light received. The electric signal is converted into digital data by a control section 110 to be described later. The digital data is then subjected to a predetermined image process and stored as image data.

The section 300 forms a color image according to image data either input externally or read from a color original document by the section 200. The section 300 has photoreceptor drums 311A to 311D, charging devices 312A to 312D, an exposure unit 313, developing devices 314A to 314D, transfer devices 315A to 315D, cleaners 316A to 316D, an intermediate transfer belt 317, and toner hoppers 321A to 321D.

In the section 300, four processing stations 330A to 330D are organized for forming images of respective colors. The stations 330A to 330D form images of black and subtractive primary colors, i.e., cyan, magenta, and yellow, respectively.

The station 330A, which is dedicated to black-color image formation, includes the photoreceptor drum 311A, the charging device 312A, the developing device 314A, the transfer device 315A, the cleaner 316A, and the toner hopper 321A. The drum 311A has a photosensitive circumferential surface and is rotatable clockwise in FIG. 1. The device 312A applies, to the surface of the drum 311A, such a voltage as to allow the surface to have a uniform electric potential.

The unit 313 irradiates the surface of each of the drums 311A to 311D with a laser light modulated according to image data of each color. The surface of the drum 311A charged by the device 312A is scanned in a fast scanning direction parallel to an axial direction of the drum 311A with a laser light modulated according to black-color image data. Consequently, an electrostatic latent image for black color is formed on the surface of the drum 311A.

The device 314A supplies black toner to the surface of the drum 311A, so that the electrostatic latent image on the surface is developed into a black toner image.

The belt 317 is an endless belt installed over a driving roller 318, a driven roller 319, and a tension roller 320. When the roller 319 is rotated, the belt 317 is rotated to travel through the stations 330D, 330C, 330B, and 330A, in that order.

In the station 330A, the belt 317 passes between the drum 311A and the device 315A. The device 315A transfers the black toner image on the drum 311A to a surface of the belt 317.

After the transfer of toner image, the cleaner 316A removes residual toner from the surface of the drum 311A.

The hopper 321A stores therein black toner to refill the device 314 with. When the amount of black toner stored therein is small, the device 314A is refilled with black toner through a supply route (not shown) from the hopper 321A.

The stations 330A to 330D are similar in configuration, except that the devices 314A to 314D, and the hoppers 321A to 321D, store different color toners therein. In the stations 330B to 330D as well, cyan, magenta, and yellow toner images are transferred to the surface of the belt 317. While the belt 317 is traveling through the stations 330A to 330D, yellow, magenta, cyan, and black toner images are sequentially accumulated on the belt 317 to form a full-color toner image.

The section 400 forms a black-and-white image according to image data either input externally or read from an original document by the section 200. The section 400 has a photoreceptor drum 411, a charging device 412, an exposure unit 413, a developing device 414, a transfer device 415, a cleaner 416, and a toner hopper 417.

The drum 411 has a photosensitive circumferential surface and is rotatable clockwise in FIG. 1. The device 412 applies, to the surface of the drum 411, such a voltage as to allow the surface to have a uniform electric potential. The unit 413 irradiates the surface of the drum 411 with a laser light modulated according to image data. Thus, the surface of the drum 411 charged by the device 412 is scanned in a fast scanning direction parallel to an axial direction of the drum 411 with the laser light. Consequently, an electrostatic latent image according to the image data is formed on the surface of the drum 411.

The device 414 supplies black toner to the surface of the drum 411, so that the electrostatic latent image on the surface is developed into a black toner image.

The device 415 transfers the black toner image on the drum 411 to paper being passed between the device 415 and the drum 411. After the transfer of toner image, the cleaner 416 removes residual toner from the surface of the drum 411.

The hopper 417 stores therein black toner to refill the device 414 with. When the amount of black toner stored therein is small, the device 414 is refilled with black toner through a supply route (not shown) from the hopper 417.

The transfer section 500 is positioned between the sections 300 and 400. The section 500 includes the device 415 as described above, an additional transfer device 501, a transport belt 502, a driving roller 503, and a driven roller 504. Referring to FIG. 1, the devices 415 and 501 are both in the shape of a roller and are rotatable clockwise or counterclockwise. Each of the devices 415 and 501 consists of metal or conductive resin or the combination of the two materials. The devices 415 and 501 may be in the shape of either a roller or a plate. Transport means includes the belt 502 and a plurality of rollers, i.e., the rollers 503 and 504. The belt 502 is an endless belt installed over the devices 415 and 501 and the rollers 503 and 504. This endless belt has a resistance of $1\times10^{8}$ Ω·cm to $1\times10^{13}$ Ω·cm.

Connected to a driving source (not shown), the roller 503 is driven clockwise or counterclockwise in FIG. 1. Examples of the driving source include, but are not limited to, a DC brushless motor and a stepping motor. In color image formation performed by the section 300, the roller 503 is driven clockwise. In black-and-white image formation performed by the section 400, the roller 503 is driven counterclockwise. The device 415 is pressed against the surface of the drum 411 through the belt 502. The device 501 is pressed against the belt 317 through the belt 502.

A portion of the belt 502 sandwiched between the device 501 and the belt 317 is the first opposing portion 512 as described earlier. A first side of the portion 512 opposing the belt 317 is hereinafter referred to as an opposing side of the portion 512. The device 501 is positioned on a second side of the portion 512. A portion of the belt 502 sandwiched between the device 415 and the drum 411 is the second opposing portion 513 as described earlier. A first side of the portion 513 opposing the drum 411 is hereinafter referred to as an opposing side of the portion 513. The device 415 is positioned on a second side of the portion 513.

The construction of the section 500 enables the two processing sections 300 and 400 to have a common, compact transfer section. The construction also allows a simplified transport path, a reduced number of component elements, and an enhanced operability.

The paper feeding section 700 has, as an example, paper cassettes 701A to 701D installed therein. Each of the cassettes 701A to 701D stores therein a predetermined number of sheets of paper of a single size. Each of the cassettes 701A to 701D has a pick-up roller 711, a feeding roller 712, and a separating roller 713. The rollers 711, 712, and 713 serve to feed paper, sheet by sheet, from any one of the cassettes 701A to 701D to the main transport path 1100.

In color image formation, the device 501 transfers a full-color toner image on the belt 317 to paper being passed through the portion 512 on the path 1100. In black-and-white image formation, the device 415 transfers a black-and-white toner image on the drum 411 to paper being passed through the portion 513 on the path 1100.

The fusing section 600 has a pair of fusing rollers 601 and 602 pressed against each other. The rollers 601 and 602 heat and pressurize paper with a transferred toner image to fix the toner image firmly on the paper.

In the first bifurcation 1300, a first switching gate 1301 is movably mounted. The switching gate 1301 is moved to transport paper in a direction from the path 1100 toward either the first paper output path 1400 or the second paper output path 1600, or to allow passage of paper between the paths 1400 and 1600.

In the second bifurcation 1500, a second switching gate 1501 is movably mounted. The switching gate 1501 is moved to transport paper in a direction toward either the second paper output section 900 or the subsidiary transport path 1700.

After passing through the section 600, paper is diverted at the bifurcation 1300 to be output to the first paper output section 800 through the path 1400 or to the second paper output section 900 through the path 1600. In color image formation, paper is output to the section 800 with an image-bearing side down (i.e., face-down) or to the section 900 with an image-bearing side up (i.e., face-up). In black-and-white image formation, in contrast, paper is output face-up to the section 800 or face-down to the section 900.

Figure 2A:
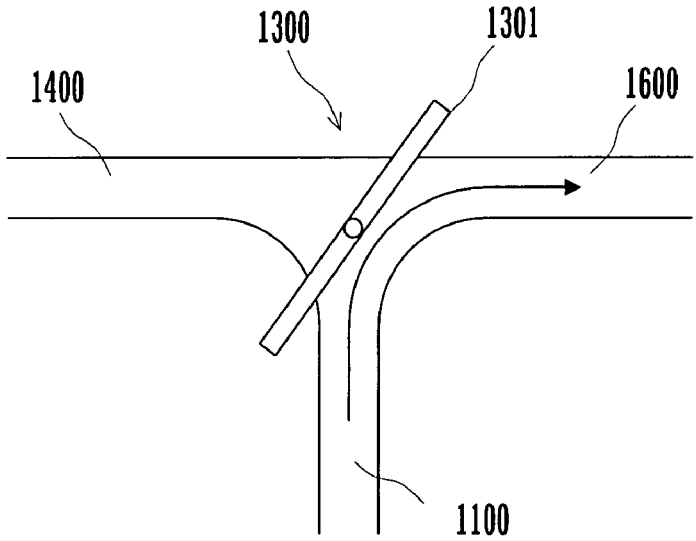
FIGS. 2A to 2C are diagrams illustrating how a first switching gate works.
Figure 2B:
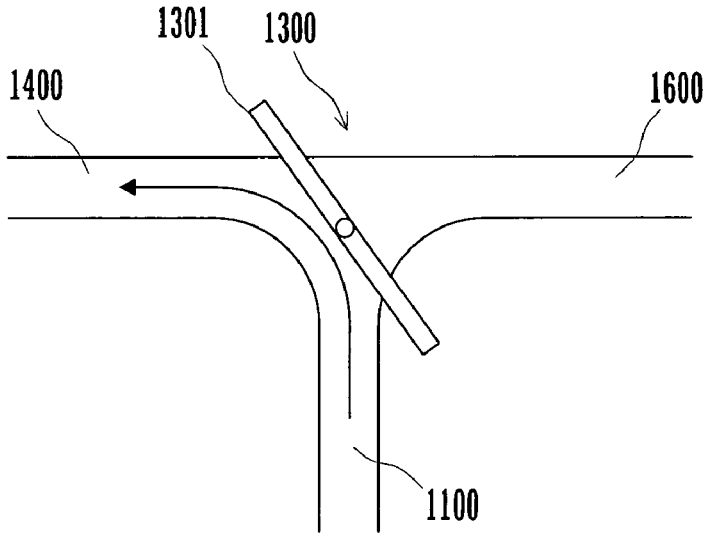
Figure 2C:
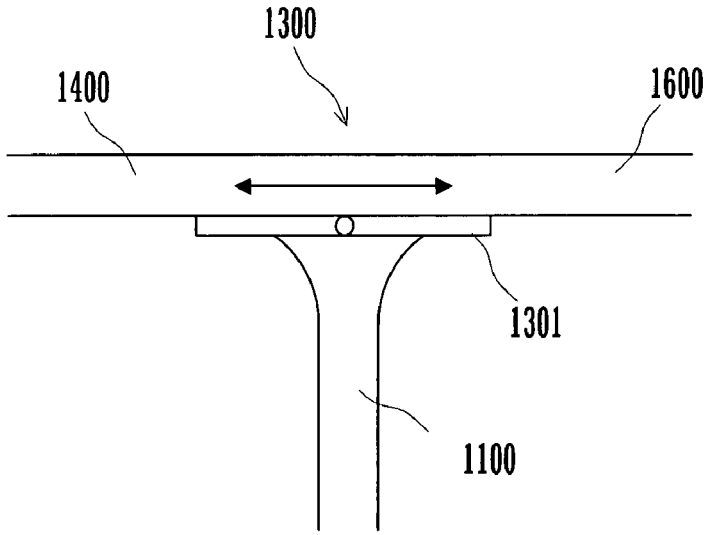

FIGS. 2A to 2C are diagrams illustrating how the first switching gate 1301 works. The switching gate 1301 is rotated by a motor (not shown) to be selectively placed in a first position P1, a second position P2, and a third position P3 as shown in FIGS. 2A to 2C, respectively.

In the position P1, the switching gate 1301 allows passage of paper from the path 1100 toward the path 1600. After an image is formed on paper in the section 300 or 400, thus, the paper is guided from the path 1100 into the path 1600.

In the position P2, the switching gate 1301 allows passage of paper from the path 1100 toward the path 1400. After an image is formed on paper in the section 300 or 400, thus, the paper is guided from the path 1100 into the path 1400.

In the position P3, the switching gate 1301 allows passage of paper between the paths 1400 and 1600. Thus, paper reversed in the path 1400 is guided into the path 1600.

Figure 3A:
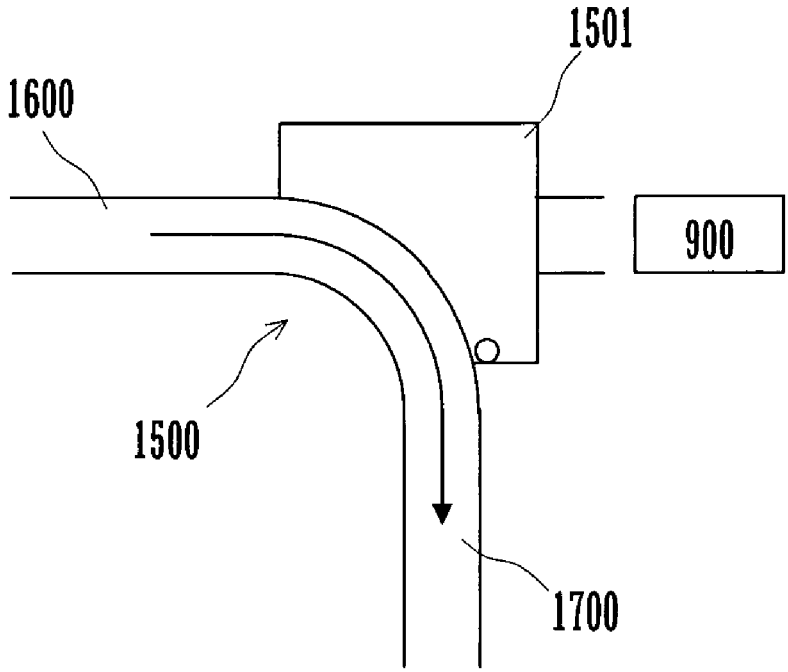
FIGS. 3A and 3B are diagrams illustrating how a second switching gate works.
Figure 3B:
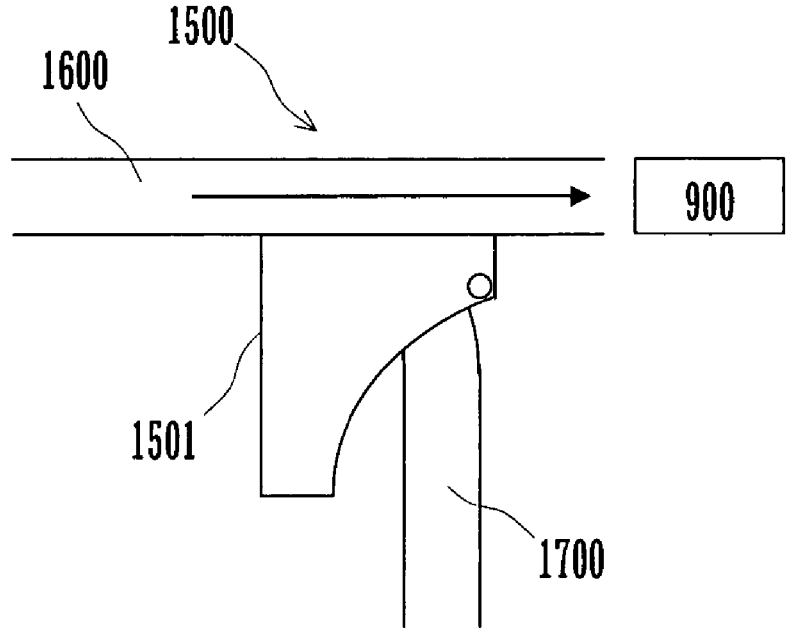

FIGS. 3A and 3B are diagrams illustrating how the second switching gate 1501 works. The switching gate 1501 is rotated by a motor (not shown) to be selectively placed in a fourth position P4 and a fifth position P5 as shown in FIGS. 3A and 3B, respectively.

In the position P4, the switching gate 1501 allows passage of paper from the path 1600 toward the path 1700. Thus, paper on the path 1600 is guided into the path 1700.

In the position P5, the switching gate 1501 allows passage of paper from the path 1600 toward the section 900. Thus, paper on the path 1600 is output to the section 900.

In duplex image formation where an image is formed on each side of paper, paper with an image formed on a first side thereof passes through the section 600 and is switched back in the path 1400. Then, the paper is transported on the path 1600 and guided into the path 1700 at the bifurcation 1700.

Figure 4:
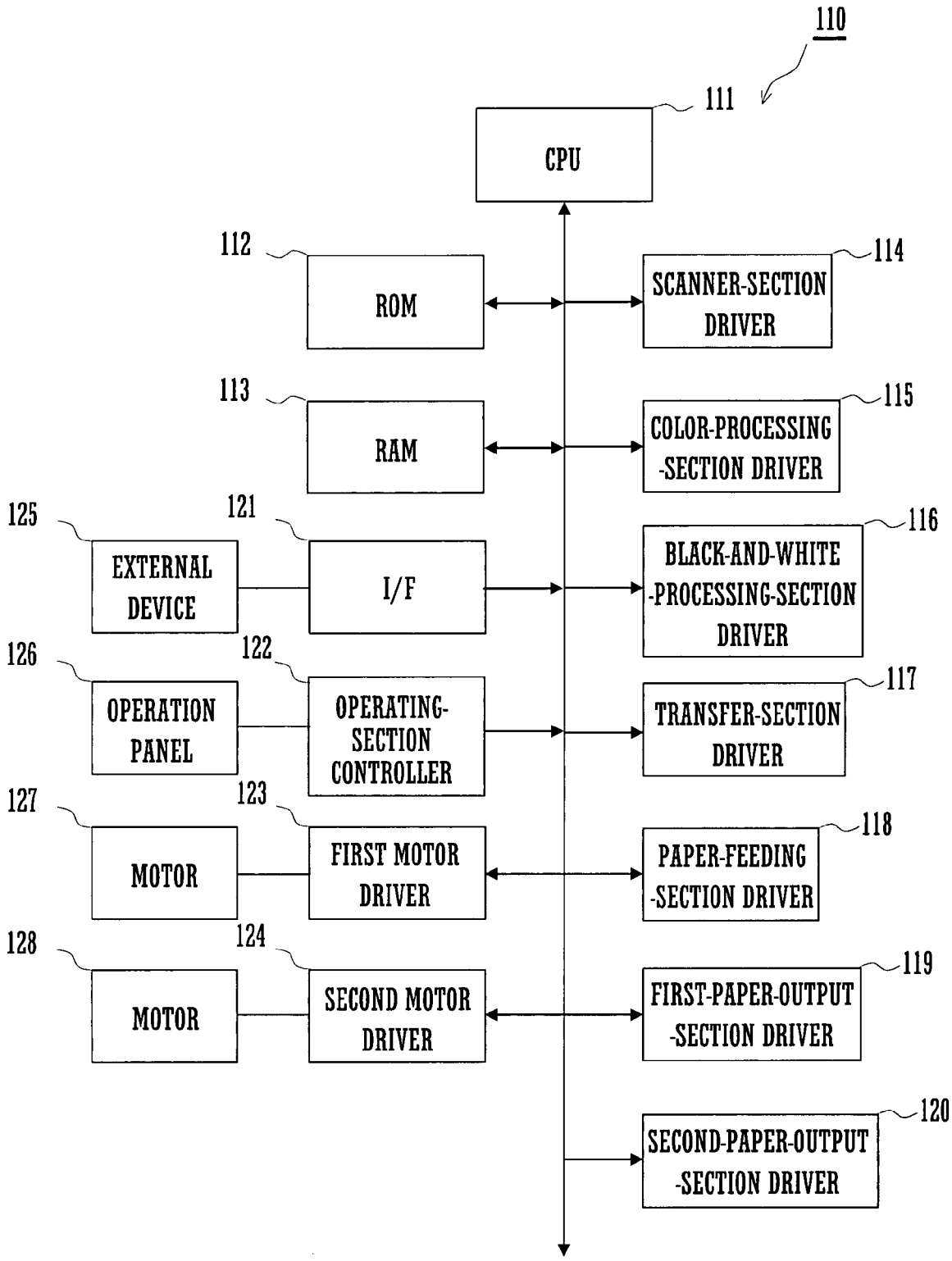
FIG. 4 is a block diagram of a control section of the apparatus.

FIG. 4 is a block diagram of the control section 110 of the apparatus. The section 110 includes CPU 111 provided with ROM 112 and RAM 113, a scanner-section driver 114, a color-processing-section driver 115, a black-and-white-processing-section driver 116, a transfer-section driver 117, a paper-feeding-section driver 118, a first-paper-output-section driver 119, a second-paper-output-section driver 120, an interface 121, an operating-section controller 122, a first motor driver 123, and a second motor driver 124.

The CPU 111 executes programs stored in the ROM 112 to control the drivers and the like. Data input or output during the execution of programs is written to the RAM 113. According to driving data output by the CPU 111, the driver 114 activates component elements, such as motors, included in the scanner section 200. The driver 115 activates component elements, such as motors or clutches, included in the color processing section 300. The driver 116 activates component elements, such as motors or clutches, included in the black-and-white processing section 400.

The driver 117 activates component elements, such as motors, included in the transfer section 500. The driver 118 activates component elements, such as motors or clutches, included in the paper feeding section 700. The driver 119 activates component elements, such as motors, included in the first paper output section 800. The driver 120 activates component elements, such as motors, included in the second paper output section 900.

The interface 121 corresponds to the input section of the Claims. To the CPU 111, a request for image formation including image data and information on image forming conditions is input from an external device 125 such as a personal computer. To the CPU 111, operation data input through an operation panel 126 is sent via the controller 122. This operation data presents descriptions of image forming conditions set by operating keys on the panel 126.

To the driver 123 connected is a motor 127 for rotating the switching gate 1301. The driver 123 activates the motor 127 according to driving data output by the CPU 111. To the driver 124 connected is a motor 128 for rotating the switching gate 1501. The driver 124 activates the motor 128 according to driving data output by the CPU 111.

Figure 5:
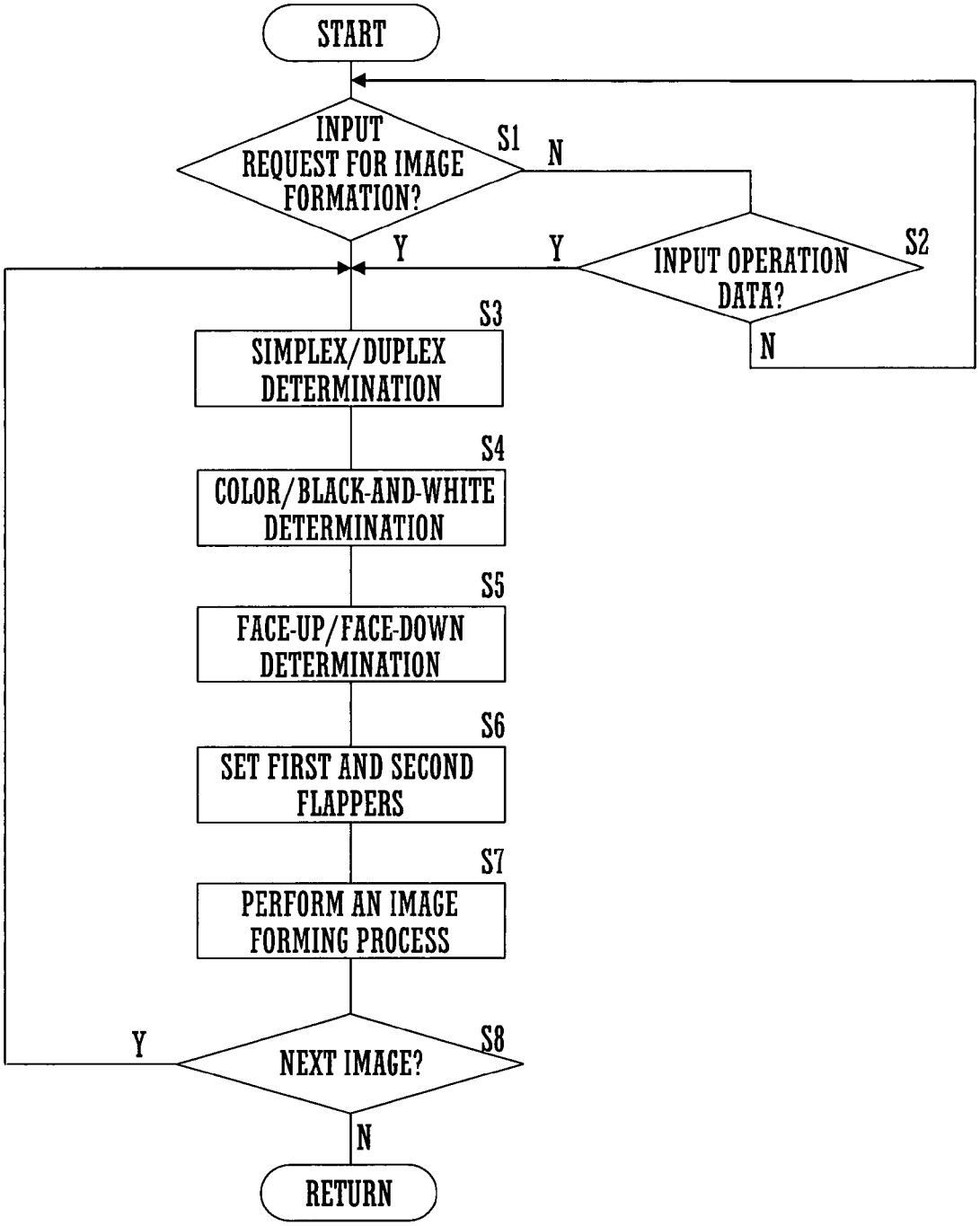
FIG. 5 is a flowchart illustrating steps of a process performed by the control section.

FIG. 5 is a flowchart illustrating part of steps of a process performed by the section 110. The CPU 111 waits for input of a request for image formation from the external device 125 or input of operation data from the controller 122 (steps S1 and S2). Upon input of a request for image formation or operation data, the CPU 111 determines, as image forming conditions, whether simplex or duplex image formation is to be performed, whether color or black-and-white image formation is to be performed, and whether paper is to be output face-up or face-down (steps S3 to S5).

Based on the determination results obtained in the steps S3 to S5, the CPU 111 moves the switching gates 1301 and 1501 as shown in FIG. 6 (step S6), and performs an image forming process according to image data input from the device 125 of read from an original document by the section 200 (step S7). The CPU 111 performs the steps S3 to S7 with respect to all image data (step S8).

It is to be noted that, when determining in the step S3 that duplex image formation is to be performed, the CPU 111 makes the determination of the step S4 with respect to both sides of paper.

Thus, paper with a color image formed on a single side thereof is output face-down to the first paper output section 800 or face-up to the second paper output section 900. Paper with a black-and-white image formed on a single side thereof is output face-up to the section 800 or face-down to the section 900.

In duplex image formation performed on a plurality of sheets of paper, outputting paper sheets face-up prevents the sheets from being collated. Accordingly, paper is output face-down in duplex image formation performed on a plurality of sheets of paper. Paper with a color or black-and-white image formed on both sides thereof, with a color image on a first side and a black-and-white image on a second side, or with a black-and-white image on the first side and a color image on the second side can be selectively output face-down to the sections 800 and 900.

As described so far, the apparatus 100 can transport paper along a single transport route by moving the switching gates 1301 and 1501 as appropriate according to various image forming conditions as set, regardless of which one of the processing sections 300 and 400 forms an image on the paper. The simple transport route allows the apparatus to be small in size and have a reduced number of component elements and an enhanced operability.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

at least one paper feeding section for storing a recording medium;

a black-and-white image forming section for forming a black-and-white image on a recording medium;

a color image forming section for forming a color image on a recording medium;

a first and second paper output sections each for receiving a recording medium bearing an image formed in any one of the image forming sections;

a main transport path that leads from the paper feeding section and runs through the image forming sections;

a first and second paper output paths that branch from an end of the main transport path into the respective first and second paper output sections; and a subsidiary transport path that branches from a midway branching point of the second paper output path and joins a point of the main transport path upstream with respect to the image forming sections, wherein any one of the image forming sections selectively forms an image on a recording medium being transported on the main transport path, wherein the first paper output path transports a recording medium in forward and reverse directions, and wherein the image forming apparatus further comprises:

a first switching gate mounted at the end of the main transport path, the first switching gate selectively allowing a recording medium to pass through any one of between the main transport path and the first paper output path, between the main transport path and the second paper output path, and between the first and second paper output paths; and a second switching gate mounted at the branching point, the second switching gate selectively allowing passage of a recording medium from the second paper output path toward the second paper output section or toward the subsidiary transport path.

2. The image forming apparatus according to claim 1, wherein each of the main and subsidiary transport paths transports a recording medium only in a single direction.

3. The image forming apparatus according to claim 1, further comprising a control section for moving the first and second flappers according to determinations made as to:

which of the image forming sections is to form an image on a recording medium;

whether an image is to be formed on a single side or both sides of the recording medium;

whether the recording medium is to be output with an image-bearing side facing up or down; and which of the paper output sections the recording medium is to be output to.

4. The image forming apparatus according to claim 1, further comprising:

an input section for receiving input of information on an image to be formed by the image forming sections; and a control section for moving the first and second flappers based on image forming conditions included in the input information.

* * * * *